US009188884B2

(12) United States Patent
Zhou et al.

(10) Patent No.: US 9,188,884 B2
(45) Date of Patent: Nov. 17, 2015

(54) CHARGE TRANSPORT LAYER FOR ORGANIC PHOTOCONDUCTORS

(75) Inventors: Zhang-Lin Zhou, Palo Alto, CA (US); Krzysztof Nauka, Palo Alto, CA (US); Hou T. Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 131 days.

(21) Appl. No.: 13/308,063

(22) Filed: Nov. 30, 2011

(65) Prior Publication Data

US 2013/0137027 A1 May 30, 2013

(51) Int. Cl.

| | |
|---|---|
| ***G03G 5/047*** | (2006.01) |
| ***G03G 5/05*** | (2006.01) |
| ***G03G 5/07*** | (2006.01) |

(52) U.S. Cl.

CPC ..... *G03G 5/0525* (2013.01); *G03G 5/047* (2013.01); *G03G 5/0592* (2013.01); *G03G 5/0596* (2013.01); *G03G 5/07* (2013.01)

(58) Field of Classification Search

CPC ..... G03G 5/047
USPC ..... 430/56, 57.1, 58.05
See application file for complete search history.

(56) References Cited

U.S. PATENT DOCUMENTS

| | | | | |
|---|---|---|---|---|
| 5,089,364 | A | 2/1992 | Lee et al. | |
| 5,264,312 | A | 11/1993 | Stolka et al. | |
| 5,427,880 | A | 6/1995 | Tamura et al. | |
| 5,656,405 | A | 8/1997 | Tsushima | |
| 7,629,094 | B2 | 12/2009 | Nagai et al. | |
| 7,670,736 | B2 | 3/2010 | Yuh et al. | |
| 2005/0181291 | A1* | 8/2005 | Kami et al. | 430/66 |
| 2007/0292780 | A1 | 12/2007 | Nagai et al. | |
| 2008/0085459 | A1 | 4/2008 | Kami et al. | |
| 2010/0133515 | A1* | 6/2010 | Sheng et al. | 257/40 |
| 2011/0159419 | A1* | 6/2011 | Iwamoto et al. | 430/56 |
| 2011/0318676 | A1* | 12/2011 | Doi et al. | 430/56 |

FOREIGN PATENT DOCUMENTS

| | | | |
|---|---|---|---|
| JP | 08-176293 | * | 9/1996 |

* cited by examiner

*Primary Examiner* — Stewart Fraser
*Assistant Examiner* — Rachel L Zhang
(74) *Attorney, Agent, or Firm* — Hewlett-Packard Patent Department

(57) ABSTRACT

An organic photoconductor includes an inner charge generation layer for generating charges and an outer charge transport layer for facilitating charge transport. The charge transport layer comprises a semi-interpenetrating hole-transport polymer or oligomer network in which the polymer or oligomer is cross-linked. A process for forming a charge transport layer in an organic photoconductor is also provided.

15 Claims, 3 Drawing Sheets

CHARGE TRANSPORT LAYER FOR ORGANIC PHOTOCONDUCTORS

BACKGROUND

An organic photoconductor (OPC) is one of the components in an electrophotographic (EP) printer. A latent image, which is a surface charge pattern, is created on the OPC prior to contact with a development system containing charged marking particles. This is accomplished by uniformly charging the OPC surface, followed by selective illumination that locally generates opposite charges which then move to the surface and locally neutralize deposited charges. The OPC frequently has two layers: an inner layer for generating charges (charge generation layer—CGL) and an outer layer containing molecular moieties for facilitating charge movement (charge transport layer—CTL). The OPC element must have very uniform and defect free structural and electrical characteristics. Its usable lifetime is often determined by the occurrence of physical defects introduced by mechanical, physicochemical and electrical interactions between the surface of the CTL and one or more elements of the electrophotographic process (commonly known as "OPC wear-out"). Some of the proposed solutions addressing this issue involve coating the CTL surface with a hard, inorganic film that may significantly raise the OPC cost and introduce other deleterious effects associated with the contamination particles originating from the inorganic coating.

DETAILED DESCRIPTION

Figure 1:
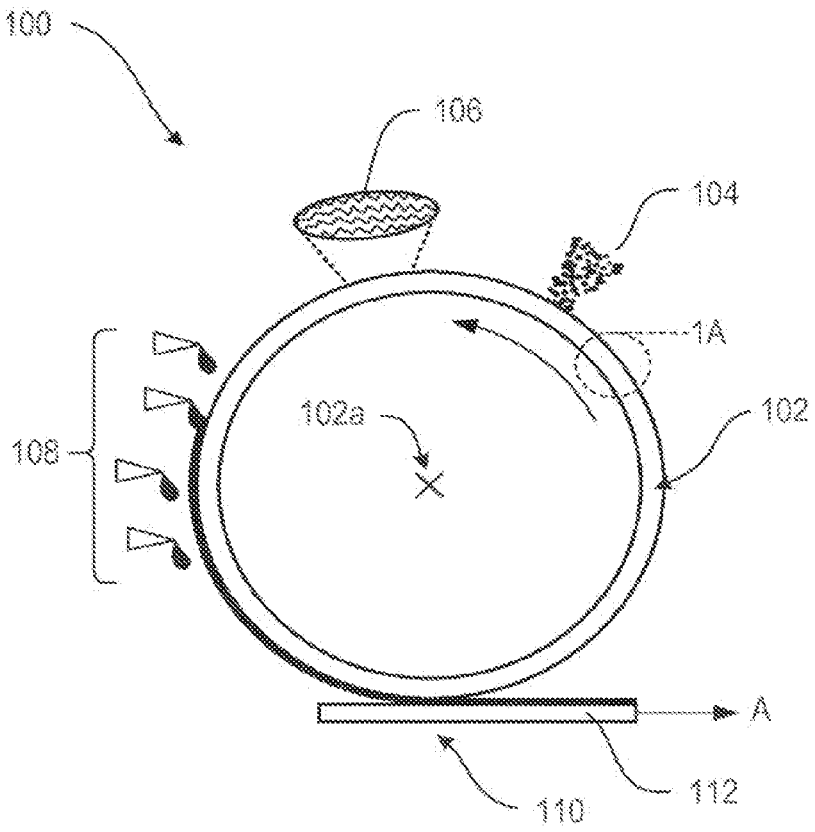
FIG. 1 is a schematic diagram of an apparatus that employs an example organic photoconductor (OPC) drum, in accordance with the teachings herein.

Reference is made now in detail to specific examples, which illustrate the best mode presently contemplated by the inventors for practicing the invention. Alternative examples are also briefly described as applicable.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "about" means a ±10% variance caused by, for example, variations in manufacturing processes.

As used herein, "alkyl" refers to a branched, unbranched, or cyclic saturated hydrocarbon group, which typically, although not necessarily, includes from 1 to 50 carbon atoms, or 1 to 30 carbon atoms, or 1 to 6 carbons, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example.

As used herein, "aryl" refers to a group including a single aromatic ring or multiple aromatic rings that are fused together, directly linked, or indirectly linked (such that the different aromatic rings are bound to a common group such as a methylene or ethylene moiety). Aryl groups described herein may include, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, "substituted" means that a hydrogen atom of a compound or moiety is replaced by another atom such as a carbon atom or a heteroatom, which is part of a group referred to as a substituent. Substituents include, but are not limited to, for example, alkyl, alkoxy, aryl, aryloxy, alkenyl, alkenoxy, alkynyl, alkynoxy, thioalkyl, thioalkenyl, thioalkynyl, and thioaryl.

The terms "halo" and "halogen" refer to a fluoro, chloro, bromo, or iodo substituent.

As used herein, "alcohol" means a lower alkyl chain alcohol, such as methanol, ethanol, n-propanol, iso-propanol, n-butanol, iso-butanol, tert-butanol, pentanol, hexanol, and their analogs.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

An example of an electrophotographic (EP) printer that may employ an organic photoconductor (OPC) is depicted in FIG. 1, which is a schematic diagram of portion of a generic EP printer. An EP printer 100 comprises an OPC drum 102 that is rotatable about an axis 102*a*. The construction of the OPC drum 102 is described in greater detail below.

As the OPC drum 102 rotates, it passes through several stations, including a charging station 104, an exposure station 106, a development station 108, and a transfer station 110.

At the charging station 104, an electrostatic charge is uniformly distributed over the surface of the OPC drum 102. Charging is typically done by a corona or a charge roller.

At the exposure station 106, also known as the image-forming station, the document to be printed or its image formed on a screen is illuminated and either passed over a lens or is scanned by a moving light and lens, such that its image is projected onto and synchronized with the moving drum surface. Where there is text or image on the document, the corresponding area of the drum remains unlit. Where there is no image, the drum is illuminated and the charge is dissipated. The charge that remains on the drum after this exposure is a "latent" image and is a negative of the original document.

At the development station 108, the drum 102 is presented with toner, e.g., liquid ink, more specifically, black ink in the case of a black ink-only printer and colored inks in the case of a color ink printer. The liquid ink is electrically charged and attracted to areas on the drum bearing complementary electrical charges.

At the transfer station 110, the ink on the drum 102 is transferred to a print medium 112, moving in the direction indicated by arrow A.

Following ink transfer, the drum 102 is prepared for a new imaging cycle.

The organic photoreceptor (OPC) in an electrophotographic printer is a thin film photoconductive layer. An electrostatic latent image is formed on the precharged photoreceptor surface via optical exposure. A visual image is obtained after the electrostatic image is developed with charged color toner particles that are subsequently transferred to paper. After the toner is transferred to paper (or other print media), the photoreceptor needs to be cleaned abrasively and corona-charged with ions to get ready for the next imaging process.

In the electrophotographic process, the photoreceptor (belt or cylinder) ideally has very uniform area characteristics: coating uniformity, dark conductivity, and photoconductivity. During each imaging cycle, the OPC surface is subjected to a number of punishing electrochemical and mechanical processes. These include corrosive ozone and oxidative reactions from corona or charge roller charging, abrasive mechanical treatments from toner development, toner transfer to paper, and doctor blade cleaning of the drum and contact with a charge roller. The essential physical properties that dictate the electrophotographic imaging process, such as dark and photo conductivity and electronic defects on the photoreceptor surface etc. would definitely accelerate their deterioration under such detrimental conditions. Therefore, it is extremely important to develop protective overcoats for the OPCs.

In the case of liquid electrophotography, these processes can be further enhanced by interactions between the solvent (usually a non-polar, isoparaffinic-based mixture) and the polymer constituting the CTL. In many cases, solvent penetrates into the CTL through openings caused by the mechanically damaged surface and causes local swelling of the CTL. The CTL damage degrades print quality, causing the OPC to be frequently replaced. Mechanical damage of the OPC is related to relatively high concentrations of the charge individual molecular conducting moieties (small molecules) that can be as high as 50% of the CTL volume. Frequent photoconductor replacement can have a negative impact on the cost of the printing process, which is particularly important for high speed/large volume printing applications, as in the case of digital commercial printers.

Previous attempts to improve the operational lifetime of the OPC surface region have relied on coating it with a layer of a "hard" inorganic film, such as carbon (e.g., graphite or diamond), silica, etc. This solution is not popular due to the following reasons: a) difficulties in forming such inorganic film on the organic substrate (lack of compatible deposition processes); b) excessively high cost of the inorganic films and their poor reliability; and c) "dust" issues due to the fact that the inorganic coating may "shed" microscopic particles caused by the mechanical interactions with the print engine components and poor adhesion of the inorganic coating to an organic substrate.

The structure of the organic photoreceptor usually has several layers of materials, each of which performs a specific function, such as charge generation, charge transport, and occasionally additional surface protection. These layers are formed by individual sequential coatings. One of these layers is the charge transport material layer. In this regard, mainly aromatic tertiary amino compounds and their corresponding polymers are used most frequently. Generally, these materials are soluble in common organic solvents such as tetrahydrofuran (THF), dichloromethane ($CH_2Cl_2$) or isopropyl alcohol (IPA). Because of their slight or high solubility in these solvents, there is always a loss of charge transport material and/or mixing with the material that is over-coated on top for protection. In addition, these materials cannot facilitate "fast" transport of electrical charges, making them irrelevant for the high-speed printing applications, such as digital commercial printing.

In accordance with the teachings herein, a CTL that is highly resistant to damage encountered during the electrophotographic process is provided. The CTL may have a semi-interpenetrating hole-transport polymer network (semi-IPN). Its components are selected to be highly solvent-resistant and scratch-resistant to the imaging process while simultaneously providing the desired electrical properties. These semi-IPNs can be easily formed by mixing either polymeric or oligomeric charge transport materials with a cross-linkable formulation that contains an initiator, a monomer, a cross-linker and surfactants in a common solvent. By an interpenetrating network is meant a polymer comprising one or more networks and one or more linear or branched polymer(s), characterized by the penetration on a molecular scale of at least one of the networks by at least some of the linear or branched macromolecules. Semi-interpenetrating polymer networks are distinguished from interpenetrating polymer networks because the constituent linear or branched polymers can, in principle, be separated from the constituent polymer network(s) without breaking chemical bonds; they are polymer blends. By oligomer is meant a molecule that consists of a few monomer units, in contrast to a polymer that, at least in principle, consists of an unlimited number of monomers. Dimers, trimers, and tetramers are usually considered to be oligomers. Use of the polymer dopant moieties permits lowering their concentration to a few volume percent while maintaining desired electrical conductivity. Thus, excessive dopant concentration responsible for lowering scratch resistance is eliminated.

Further in accordance with the teachings herein, the semi-interpenetrating hole-transport polymer network may be formed by mixing either polymeric or oligomeric charge transport materials with a cross-linkable formulation that contains at least one initiator, at least one monomer, at least one cross-linker, and at least one surfactant in a common solvent. During the coating process using this solution, either heat or UV light can be applied to polymerize the monomer(s) and cross-linker(s) that embed polymeric and oligomeric charge transport materials to form a uniform and scratch-resistant hole transport semi-IPN. Polymeric or oligomeric charge transport materials are uniformly distributed within the semi-IPNs and still can transport the hole carriers.

Such semi-IPNs can provide a very uniform and mechanically hard film that prevents the aforementioned damage commonly encountered in the case of traditional OPCs, and thus ensures an extended OPC lifetime and the associated decrease of the operating expenses. This advantage is accomplished by selecting component(s) of the IPN that have superior mechanical strength and resistance against damage.

Figure 2:
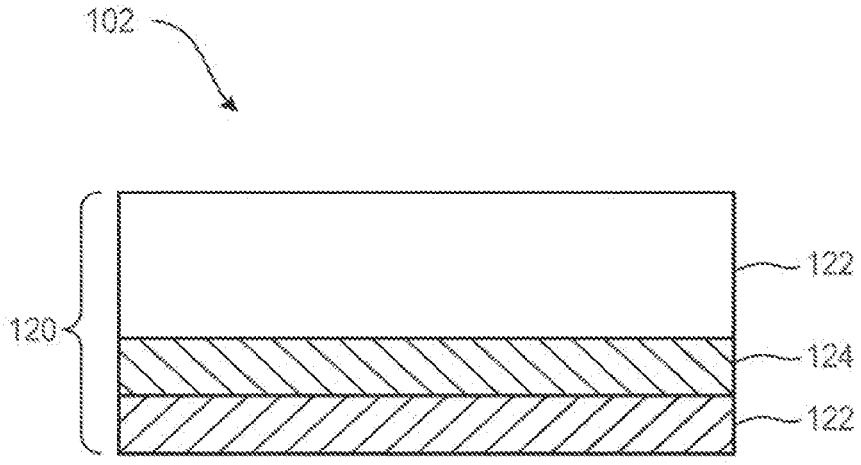
FIG. 2 is an enlargement of a portion of the OPC drum.

FIG. 2 is an enlargement of a portion of the drum 102 of FIG. 1, and depicts an example configuration in accordance with the teachings herein. An OPC 120 comprises a conductive substrate 122, a charge generation layer (CGL) 124, and a charge transport layer (CTL) 126. The CTL 126 may include the semi-interpenetrating hole-transport polymer network. The thickness of the CTL 126 may be greater than 10

μm. A protective coating (not shown) may be formed on the exterior surface of the CTL 126.

Figure 3:
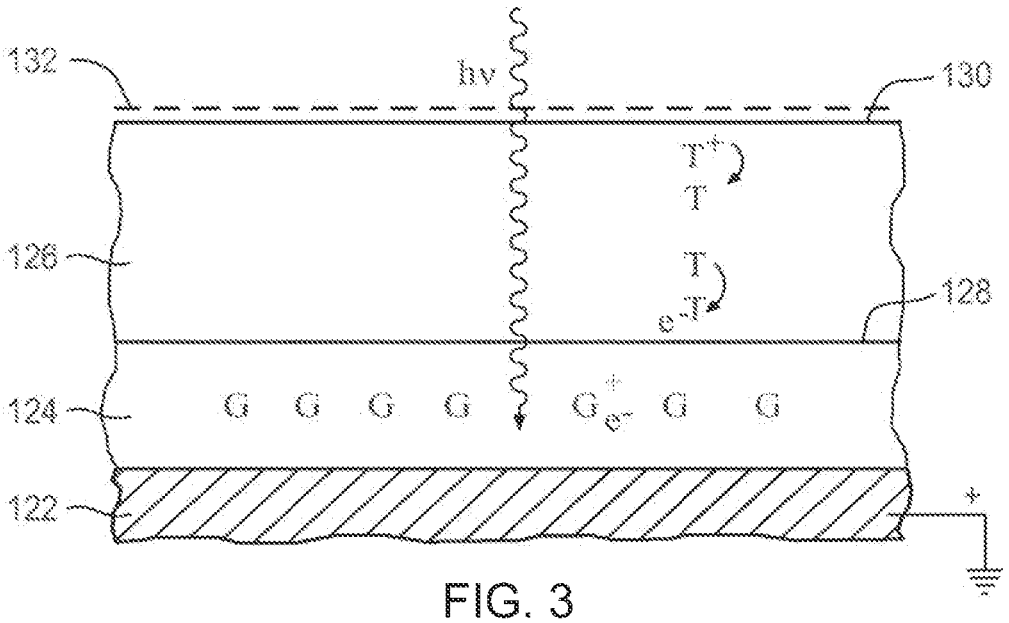
FIG. 3 schematically depicts a photoconductive mechanism of the example OPC.

FIG. 3 is a schematic diagram depicting the photoconductive mechanism of an organic photoconductors (OPC), which is a dual-layer device comprising a thin (about 0.1 to 1.0 μm) charge generation layer (CGL) 124 on top of which is a thicker (about 20 μm) charge-transport layer (CTL) 126. Light hv passes through the transparent CTL 126 and strikes the CGL 124, which generates free electrons $e^-$ and holes $h^+$. Electrons are collected by an electrical ground (the conductive substrate 122) of the photoreceptor and holes are driven to the CGL-CTL interface 128 under an applied electrical field (not shown). The CTL 126 allows holes to be transported to the photoreceptor surface 130 to neutralize the negative ions 132 that are deposited during the pre-charging process. Thus, the active chemicals in OPCs are the charge-generation materials (CGMs, denoted G in FIG. 3) in the CGL 124 and the charge-transport materials (CTMs, denoted T in FIG. 3) in the CTL 126. The CGMs are usually photo pigments including polyazo compounds, perylene, tetracarboxydiimides, polycyclic quinoes, phthalocyanines, and squariliums, and the CTMs are conductive organic small molecules, oligomers or polymers such as aryl hydrazones, aminoaryl heterocycles such as oxadiazole and especially highly conjugated arylamines, which are usually transparent.

A novel and unique process is provided to improve the operational time of OPC by using semi-interpenetrating hole-transport polymer networks (hole transporting semi-IPNs) as charge transport layer (CTL), which is formed by mixing either polymeric or oligomeric charge transport materials with a cross-linkable formulation that contains an initiator, a monomer, a cross-linker and surfactants in a common solvent. As a result, polymeric or oligomeric charge transport materials are embedded in a cross-linked polymer matrix that form semi-IPNs. Molecules of the charge transport materials are substantially uniformly distributed within such IPN and are capable of transporting the hole carriers. Such a semi-IPN is a very uniform and robust film; it can sustain scratch, solvent and any physical contact in the electro-photographic process.

To form the polymeric or oligomeric charge transport materials embedded in the cross-linked polymeric matrix, the following components are combined as described in greater detail below:

about 0.1 to 40 wt % hole transport polymer or oligomer:
about 0.1 to 50 wt % cross-linkable monomer;
about 0.1 to 50 wt % cross-linking agent;
about 0.1 to 20 wt % initiator; and
at least about 20 wt % solvent.

Figure 4:
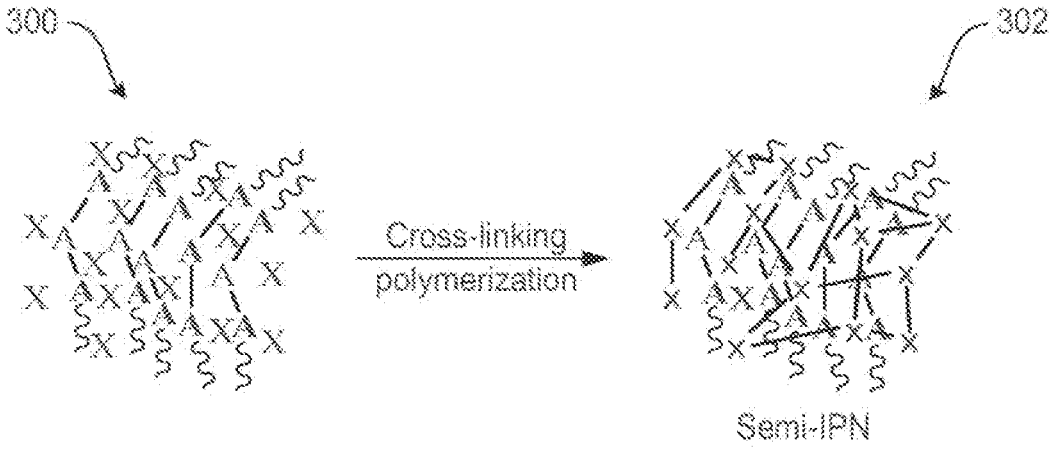
FIG. 4 is a schematic representation of cross-linking polymerization to form a semi-interpenetrating network (semi-IPN), in accordance with an example.

FIGS. 3 and 4 show schematic processes for the formation of a hole transport semi-IPN 302 from hole transport polymer (s) or oligomer(s) 300. The hole transport polymer(s) or oligomer(s) 300 may be mixed with cross-linkable monomer(s), cross-linking agent(s), and initiator(s) in selected common solvent(s) and applied on top of the CGL 124, such as by roll-coating, dip coating, spray coating, roll-to-roll coating, printing methods, and the like.

After the coating, the film may be subjected to either heat for a period of time, typically a few hours, or UV for a period of time, typically a few minutes. As a consequence of this curing, the film may become cross-linked to form semi-IPNs 302 with hole transporting properties, which can function as the CTL 126 for high performance organic photoconductors. The term "solution" means the mixture of monomers, cross-linkers, initiators, and certain organic solvent(s) in which both initiators and charge transport materials can be dissolved. The term "certain organic solvent(s)" means a commonly used organic solvent or mixture of commonly used organic solvents, such as but not limited to $CHCl_3$, toluene, xylenes, methanol, ethanol, iso-propanol, hexafluoro-isopropoal, THF, benzene, DMF, and the like.

If subjected to thermal cross-linking, the mixture on the charge generation layer may be cross-linked by exposure to heat for a period of time. Typically, the mixture may be cross-linked at a temperature within a range of about 25° to 120° C. for about 1 to 50 hours. Shorter curing times may be associated with higher temperatures.

If subjected to photo cross-linking, the mixture on the charge generation layer may be cross-linked by exposure to ultraviolet (UV) radiation for a period of time. Typically, the mixture may be cross-linked by UV radiation within a range of about 255 to 385 nm for about 1 to 60 minutes. Shorter curing times may be associated with shorter wavelength and with higher intensity.

FIG. 4 is a schematic illustration showing the formation of the semi-IPNs 302 by a cross-linking polymerization. In FIG. 4, A is the repeat unit and/or fragments of hole transporting polymers or oligomers, while X is the monomer or cross-linker and x is the cross-linked polymer.

Figure 5:
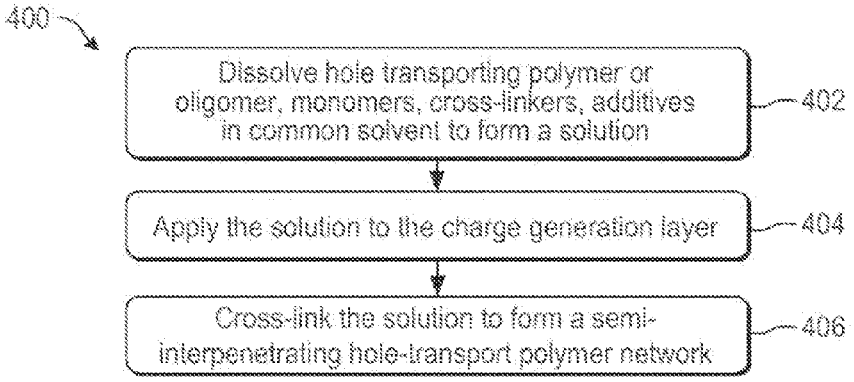
FIG. 5 depicts an example process for forming a hole-transporting semi-IPN as a charge transport layer for an OPC.

FIG. 5 illustrates an example process 400 for forming hole-transporting semi-IPNs 302 as the charge transport layer 126 for an organic photoconductor 120.

Again, A is the repeat unit and/or fragments of hole transporting polymers or oligomers, X is the monomer or cross-linker, and x is the cross-linked polymer. "A" contains hole transporting polymers or oligomers that can be dissolved or swollen within X, which can then be polymerized and crosslinked to provide hole transporting IPNs. The compositions of "A" and "X" are described in greater detail below, following a description of FIG. 5.

In block 402, a hole transporting polymer or oligomer may be dissolved along with a monomer, a cross-linker, and an additive, if desired, in a solvent that is common to all materials to form a solution.

Figure 6:
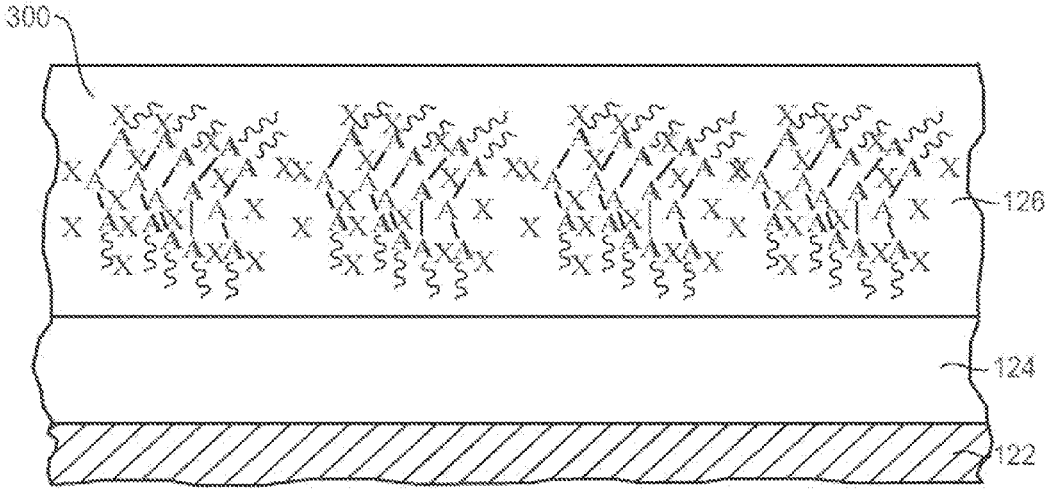
FIGS. 6 and 7 are each a schematic representation of the OPC during stages of the process of FIG. 5.

In block 404, the solution from block 402 may be coated on top of the charge generating layer 124. The resulting structure is schematically depicted in FIG. 6.

Figure 7:
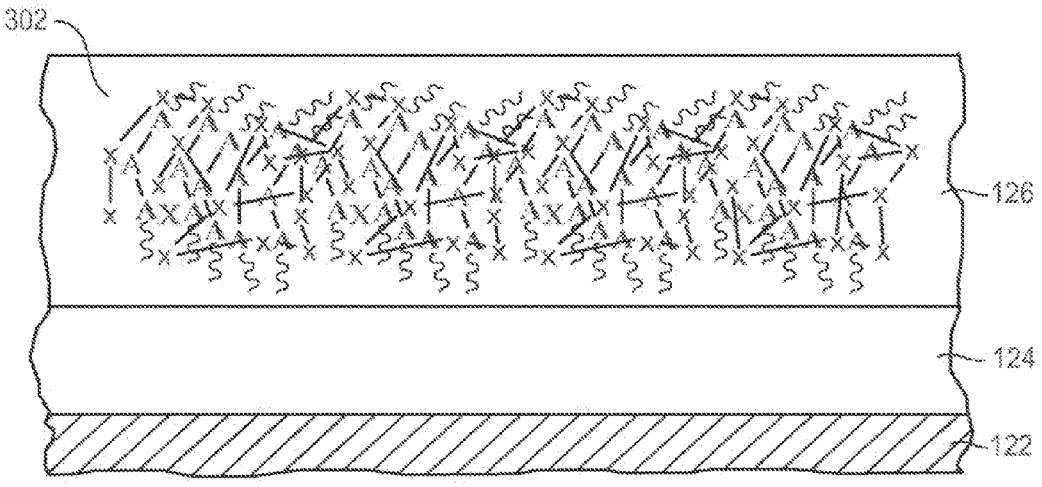

In block 406, the structure from block 404 may be subjected to thermal or UV curing to cross-link the polymer or oligomer to form the hole-transporting semi-IPN as the charge transport layer 126. The resulting structure is schematically depicted in FIG. 7.

Hole Transport Polymers or Oligomers

The hole transport polymers or oligomers denoted as "A" may be, but are not limited to, semiconducting conjugated polymers, and may have, but are not limited to, a chemical structure shown in Formula I:

Formula I

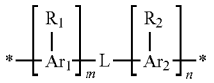

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, C(O)OR4, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from the group consisting of hydrogen, C1-C30 alkyl and C1-C30 aryl, and the like;

L is a linker that connects two aromatic rings; in this case, it can be either nitrogen or a single bond; and m and n are integers independently between 0 and about 5,000, with the proviso that at least one of m or n is not 0.

The phrase "aromatic ring moiety" or "aromatic" as used herein includes monocyclic rings, bicyclic ring systems, and polycyclic ring systems, in which the monocyclic ring, or at least a portion of the bicyclic ring system or polycyclic ring system, is aromatic (that is, it exhibits π-conjugation). The monocyclic rings, bicyclic ring systems, and polycyclic ring systems of the aromatic ring moiety may include carbocyclic rings and/or heterocyclic rings. The term "carbocyclic ring" denotes a ring in which each ring atom is carbon. The term "heterocyclic ring" denotes a ring in which at least one ring atom is not carbon and comprises 1 to 4 heteroatoms.

By way of example and not limitation, each of $Ar_1$ and $Ar_2$ may be independently selected from the group consisting of: phenyl, fluorenyl, biphenyl, terphenyl, tetraphenyl, naphthyl, anthryl, pyrenyl, phenanthryl, thiophenyl, pyrrolyl, furanyl, imidazolyl, triazolyl, isoxazolyl, oxazolyl, oxadiazolyl, furazanyl, pyridyl, bipyridyl, pyridazinyl, pyrimidyl, pyrazinyl, triazinyl, tetrazinyl, benzofuranyl, benzothiophenyl, indolyl, isoindazolyl, benzimidazolyl, benzotriazolyl, benzoxazolyl, quinolyl, isoquinolyl, cinnolyl, quinazolyl, naphthyridyl, phthalazyl, phentriazyl, benzotetrazyl, carbazolyl, dibenzofuranyl, dibenzothiophenyl, acridyl, and phenazyl.

Cross-Linkable Monomers

X may be cross-linkable monomers, oligomers or polymers containing cross-linking agent(s) and initiator or initiators. Cross-linking agents may be but are not limited to 2-branch, 3-branch, and 4-branch cross-linker that can be initiated with appropriate energy. Initiators can be but are not limited to thermal- and photo-initiators. Examples of cross-linkable monomers include, but are not limited to, N-alkyl acrylamides, N-aryl acrylamides and N-alkoxyalkyl acrylamides. Specific examples include N-methyl acrylamide, N-ethyl acrylamide, N-butyl acrylamide, N,N-dimethyl acrylamide, N,N-dipropyl acrylamide, N-(1,1,2-trimethylpropyl) acrylamide, N-(1,1,3,3-tetramethylbutyl) acrylamide, N-methoxymethyl acrylamide, N-methoxyethyl acrylamide, N-methoxypropyl acrylamide, N-butoxymethyl acrylamide, N-isopropyl acrylamide, N-s-butyl acrylamide, N-t-butyl acrylamide, N-cyclohexyl acrylamide, N-(1,1-dimethyl-3-oxobutyl) acrylamide, N-(2-carboxyethyl) acrylamide, 3-acrylamido-3-methyl butanoic acid, methylene bisacrylamide, N-(3-aminopropyl) acrylamide hydrochloride, N-(3,3-dimethylaminopropyl) acrylamide hydrochloride, N-(1-phthalamidomethyl) acrylamide, sodium N-(1,1-dimethyl-2-sulfoethyl) acrylamide and the corresponding methacrylamides and combinations of two or more of the above mentioned compounds. Further examples, by way of illustration and not limitation, include N-vinyl amides, for example, N-methyl N-vinyl acetamide, N-vinyl acetamide, N-vinyl formamide and N-vinylmethacetamide; N-vinyl cyclic amides, for example, N-vinylpyrrolidone and N-vinyl-3-morpholinone; heterocyclic vinyl amines, for example, N-vinylpyridine, N-vinyloxazolidines, N-vinylpyrimidine, N-vinylpyridazine, N-vinyl-1,2,4-triazine, N-vinyl-1,3,5-triazine, N-vinyl-1,2,3-triazine, N-vinyl-triazole, N-vinyl-imidazole, N-vinylpyrrole and N-vinylpyrazine; polyethylene glycolated acrylates, for example, polyethylene glycoldi (meth)acrylate, ethylene glycol di(meth)acrylate, triethylene glycol di(meth)acrylate and tetraethylene glycol di(meth) acrylate; polyethylene glycolated methacrylates, for example, methylacrylamide glycolate methylether, polyethylene glycol mono(meth)acrylate, methoxypolyethylene glycol mono(meth)acrylate, octoxypolyethylene glycol mono (meth)acrylate and stearoxypolyethylene glycol mono(meth) acrylate; and combinations of two or more of the above mentioned compounds. Further examples, by way of illustration and not limitation, include cationic monomers, for example, N,N-dimethylaminoethyl methacrylate, N,N-dimethyl-aminoethyl acrylate, N,N-dimethylaminopropyl methacrylate, N,N-dimethylaminopropyl acrylate, N,N-dimethylacrylamide, N,N-di methylmethacrylamide, N,N-dimethylaminoethylacrylamide, N,N-dimethylaminoethylmethacrylamide, N,N-dimethylaminopropylacrylamide, and N,N-dimethylaminopropyl-methacrylamide.

Cross-Linking Agents

The cross-linking agent may be a 2-branch, 3-branch, or 4-branch cross-linker that can be initiated with appropriate energy provided by heat or UV. Both photo and thermally curable formulations have been employed in the practice of the invention.

One example of a cross-linking agent may include a UV- or thermal-initiated cross-linking of acrylate monomers and cross-linkers. In this example, a cross-linked polyacrylate network is formed from a co-monomer mixture having (a) 5 to 20 wt % (weight percent) of a nitrogen-containing monomer, which serves as hydrophilic monomer as well as chain propagation accelerator; (b) 20 to 50 wt % of a two-branch acrylate cross-linking monomer; (c) 5 to 20 wt % of a three-branch or four-branch cross-linking monomer to increase cross-linking density; and (d) 1 to 10 wt % of a photo-initiator or a thermal-initiator. Another example includes the use of a special initiator system having (i) a photo- or thermal-initiator component; and (ii) an accelerator component comprising a nitrogen-containing monomer.

Examples of polyfunctional cross-linking agents, by way of illustration and not limitation, may include multifunctional acrylates such as diacrylates, triacrylates, tetraacrylates, and the like. In some examples, the multifunctional acrylates may include a portion or moiety that functions as a polymer precursor as described hereinbelow. Examples of multifunctional acrylate monomers or oligomers that may be employed as the polyfunctional cross-linking agent (some of which may include a polymer precursor moiety) in the present embodiments, by way of illustration and not limitation, include diacrylates such as propoxylated neopentyl glycol diacrylate (available from Atofina Chemicals, Inc., Philadelphia Pa., as Sartomer SR 9003), 1,6-hexanediol diacrylate (available from Sartomer Company, Inc., Exton, Pa., as Sartomer SR 238), tripropylene glycol diacrylate, dipropylene glycol diacrylate, aliphatic diacrylate oligomer (available from Atofina as CN 132), aliphatic urethane diacrylate (available from Atofina as CN 981), and aromatic urethane diacrylate (available from Atofina as CN 976), triacrylates or higher functionality monomers or oligomers such as amine modified polyether acrylates (available from BASF Corporation as PO 83 F, LR 8869, or LR 8889), trimethylol propane triacrylate (Sartomer SR 351), tris(2-hydroxy ethyl) isocyanurate triacrylate (Sartomer SR 368), aromatic urethane triacrylate (CN 970 from Atofina), dipentaerythritol penta-/hexa-acrylate, pentaerythritol tetraacrylate (Sartomer SR 295), ethoxylated pentaerythritol tetraacrylate (Sartomer SR 494), and dipentaerythritol pentaacrylate (Sartomer SR 399), or mixtures of any of the foregoing. Additional examples of suitable cross-linking additives include chlorinated polyester acrylate (Sartomer CN 2100), amine modified epoxy acrylate (Sartomer CN 2100), aromatic urethane acrylate (Sartomer CN 2901), and polyurethane acrylate (Laromer LR 8949 from BASF).

Other examples of polyfunctional cross-linking agents include, for example, end-capped acrylate moieties present on such oligomers as epoxy-acrylates, polyester-acrylates, acrylate oligomers, polyether acrylates, polyether-urethane acrylates, polyester-urethane acrylates, and polyurethanes end-capped with acrylate moieties such as hydroxyethyl acrylate. Further, the polyurethane oligomer can be prepared utilizing an aliphatic diisocyanate such as hexamethylene diisocyanate, cyclohexane diisocyanate, diisocyclohexylmethane diisocyanate, isophorone diisocyanate, for example. Other examples include isophorone diisocyanate, polyester polyurethane prepared from adipic acid and neopentyl glycol, for example. Specific examples of polyfunctional cross-linking agents that include isocyanate functionalities and acrylate functionalities include materials sold by Sartomer Company such as, for example, CN966-H90, CN964, CN966, CN981, CN982, CN986, Pro1154, and CN301.

Initiators

The liquid solvent mixture further may include at least one initiator which may be activated by thermal or photo (UV) energy.

Examples of suitable thermal initiators include organic peroxides, azo compounds and inorganic peroxides. Illustrative examples of organic peroxides include diacyl peroxide, peroxycarbonate, and peroxyester. In some examples, the organic peroxide may be a radical initiator such as isobutyl peroxide, lauroyl peroxide, stearyl peroxide, succinic acid peroxide, di-n-propyl peroxydicarbonate, diisopropyl peroxydicarbonate, or bis(4-tert-butylcyclohexyl)peroxy-dicarbonate. Examples of the inorganic initiators may include ammonium persulfate, sodium persulfate, and potassium persulfate. Combinations of two or more of the above may also be employed.

Examples of suitable photo initiators include 2,4,6-trimethyl-benzoyldiphenylphosphine oxide (available as BASF Lucirin TPO), 2,4,6-trimethyl-benzoylethoxyphenylphosphine oxide (available as BASF Lucirin TPO-L), bis(2,4,6-trimethylbenzoyl)-phenyl-phosphine oxide (available as Ciba IRGACURE 819) and other acyl phosphines, 2-benzyl 2-dimethylamino 1-(4-morpholinophenyl) butanone-1 (available as Ciba IRGACURE 369), titanocenes, and isopropylthioxanthone, 1-hydroxy-cyclohexylphenylketone, benzophenone, 2,4,6-trimethylbenzophenone, 4-methyl-benzophenone, 2-methyl-1-(4-methylthio)phenyl-2-(4-morphorlinyl)-1-propanone, diphenyl-(2,4,6-trimethylbenzoyl)phosphine oxide, 2,4,6-trimethylbenzoylphenyl-phosphinic acid ethyl ester, oligo-(2-hydroxy-2-methyl-1-(4-(1-methylvinyl)phenyl) propanone), 2-hydroxy-2-methyl-1-phenyl-1-propanone, benzyl-dimethylketal, t-butoxy-3,5,3-trimethylhexane, benzophenone, 2-hydroxy-2-methyl-1-phenyl-1-propanone, anisoin, benzil, camphorquinone, 1-hydroxycyclohexylphenyl ketone, 2-benzyl-2-dimethylamino-1-(4-morph-olinophenyl)-butan-1-one, 2,2-dimethoxy-2-phenylacetophenone, 2-methyl-1-[4-(methylthio)phenyl]-2-(4-morpholinyl)-1-propanone, and mixtures or two or more of the above. Also included are amine synergists such as, for example, ethyl-4-dimethylaminobenzoate and 2-ethylhexyl-4-dimethylamino benzoate. This list is not exhaustive and any known photopolymerization initiator that initiates a free radical reaction upon exposure to a desired wavelength of radiation such as UV light may be used. Combinations of one or more of the above may also be employed in some examples.

Solvents

The organic solvent or mixture of commonly used organic solvents employed in the practice of the invention have been listed above. These may include, but are not limited to, $CHCl_3$, toluene, xylenes, methanol, ethanol, isopropanol, hexafluoro-iso-propanol, THF, benzene, DMF, mixtures thereof, and the like.

As indicated above, the solvent selected may be one that dissolves all of the components to form a solution.

Further Considerations

In some examples, hard nanoparticles such as $SiO_2$, $TiO_2$, or other inorganic oxide, nitride, or carbide may be added to the formulations to further improve the scratch resistance of the OPC. Such oxides may be functionalized, using commonly-known procedures, so that they can be dissolved into the common solvents previously mentioned. The concentration of such inorganic oxide, nitride, or carbide may vary from about 1 to 20 wt %. The particle size may be below 100 nm.

EXAMPLES

The following examples are used to illustrate aspects of the teachings herein.

Example 1

Preparation of Hole Transporting Semi-IPN for CTL Formulation 1

To a 100 ml bottle are added N-vinylpyrrolidone (65 mg), ethoxylated bisphenol A dimethylacrylate (160 mg), trimethylolpropane trimethylacrylate (200 mg), tert-butoxy-3,5,7-trimethylhexanoate (25 mg), polyarylamine-based hole transport material (60 mg), and 50 ml of toluene. The resulting mixture is sonicated for one hour. The formulation is ready for use as a high performance OPC coating.

Example 2

Preparation of Hole Transporting Demi-IPN for CTL Formulation 2

To a 100 ml bottle are added N-vinylpyrrolidone (65 mg), ethoxylated bisphenol A dimethylacrylate (160 mg), tripropylene glycol diacrylate (200 mg), lauroyl peroxide (25 mg), polyarylamine-based hole transport material (60 mg), and 50 ml of toluene. The resulting mixture is sonicated for one hour. The formulation is ready for use as a high performance OPC coating.

Example 3

Preparation of Hole Transporting Semi-IPN for CTL Formulation 3

To a 100 ml bottle are added N-vinylpyrrolidone (65 mg), aliphatic urethane diacrylate (160 mg), trimethylolpropane trimethylacrylate (200 mg), diisopropyl peroxydicarbonate (25 mg), polyarylamine-based hole transport material (60 mg), and 50 ml of toluene. The resulting mixture is sonicated for one hour. The formulation is ready for use as a high performance OPC coating.

Example 4

Preparation of Hole Transporting Semi-IPN for CTL Formulation 4

To a 100 ml bottle are added N-vinylpyrrolidone (65 mg), ethoxylated bisphenol A dimethylacrylate (160 mg), ethoxylated pentaerythritol tetraacrylate (200 mg), bis(2,4,6-trimethylbenzoyl)-phenyl-phosphine oxide (25 mg), polyarylamine-based hole transport material (60 mg), and 50 ml of toluene. The resulting mixture is sonicated for one hour. The formulation is ready for use as a high performance OPC coating.

Example 5

Preparation of Hole Transporting Semi-IPN for CTL Formulation 5

To a 100 ml bottle are added N-vinylpyrrolidone (65 mg), ethoxylated bisphenol A dimethylacrylate (160 mg), trimethylolpropane trimethylacrylate (200 mg), 2,2-dimethoxy-2-phenylacetophenone (25 mg), hydrazone-based hole transport material (60 mg), and 50 ml of toluene. The resulting mixture is sonicated for one hour. The formulation is ready for use as a high performance OPC coating.

Example 6

Preparation of Hole Transporting Semi-IPN for CTL Formulation 6

To a 100 ml bottle are added N-vinylpyrrolidone (65 mg), ethoxylated bisphenol A dimethylacrylate (160 mg), trimethylolpropane trimethylacrylate (200 mg), 2-methyl-1-[4-(methylthio)phenyl]-2-(4-morpholinyl)-1-propanone (25 mg), oxadiazole-based hole transport material (60 mg), and 50 ml of toluene. The resulting mixture is sonicated for one hour. The formulation is ready for use as a high performance OPC coating.

In summary, a novel strategy is provided to improve the lifetime and performance of organic photoconductors (OPCs) by using semi-interpenetrating hole-transporting polymer networks as the charge transport layer (CTL). This hole transporting semi-IPN does not dissolve in most organic solvents. Molecules of the charge transport materials are uniformly distributed within this semi-IPN and still transport the hole carriers. This greatly improves the integrity of the organic photoconductor and allows a variety of solvents to be used in the printing process. Consequently, the operational life time of the OPC is improved. The process described herein has the following major advantages: Firstly, this process could potentially eliminate the need for over-coating material. Since the semi-IPN is very uniform and robust, it can sustain scratching, dissolution in solvent, and any physical contact in the electro-photographic process. Secondly, this process allows broad choices of any polymeric or oligomeric hole transporting materials that are soluble in common solvents. Thirdly, the intrinsic nature of IPNs renders the charge transport species immobile and preserves their uniform distribution within the CTL during the over-coating process. This results in a tougher charge transporting film under both mechanical and thermal processes, which in turn greatly improves the integrity and operation time of OPC.

An additional advantage offered by the semi-IPN is due to the fact that in the case of the LEP (liquid photolithography), interactions between the OPC and printing solvent (imaging oil in the case of the Indigo printing process) may cause some swelling of the polymer(s) compounds within the OPC, which further decreases the OPC lifetime. Proper selections of the cross-linkable formulation can eliminate this problem as well.

A further advantage stems from the fact that charge transport moieties can be selected from a large number of commercially-available species and thus provide the desired electrical conduction characteristics. This property is important due to the need for conducting moieties with a large high-field mobility necessary for the future high-speed digital printing devices.

What is claimed is:

1. An organic photoconductor including an inner charge generation layer for generating charges and an outer charge transport layer for facilitating charge transport, wherein the charge transport layer comprises a semi-interpenetrating polymer network comprising a cross-linked polymer matrix in which a hole transport polymer or oligomer is embedded, wherein the hole transport polymer or oligomer has a chemical structure shown in Formula I:

Formula I

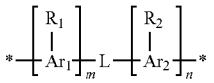

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, $C(O)OR_4$, $N(R_4)(R5)$, $C(O)N(R_4)(R5)$, F, Cl, Br, $NO_2$, CN, acyl, carboxylate and hydroxy, wherein $R_4$ and $R_5$ are each independently selected from the group consisting of hydrogen, C1-C30 alkyl, and C1-C30 aryl;

L is a linker that connects two aromatic rings selected from the group consisting of nitrogen and a single bond; and m and n are integers independently having a value between 0 and about 5,000, with the proviso that at least one of m or n is not 0.

2. The organic photoconductor of claim 1 wherein molecules of the hole transport polymer or oligomer are substantially uniformly distributed within the matrix and are capable of transporting hole carriers.

3. The organic photoconductor of claim 1 in which the cross-linked polymer matrix is based on monomers selected from the group consisting of N-alkyl acrylamides, N-aryl acrylamides and N-alkoxyalkyl acrylamides, the corresponding methacrylamides, N-vinyl amides, N-vinyl cyclic amides, heterocyclic vinyl amines, polyethylene glycolated acrylates and methacrylates, polyethylene glycolated methacrylates, cationic monomers, and combinations thereof.

4. A process for forming a charge transport layer in an organic photoconductor comprising an inner charge generation layer for generating charges and the charge transport layer on the charge generation layer, the charge transport layer for facilitating charge movement, the process including:

dissolving either a polymeric or an oligomeric charge transport material with a cross-linkable formulation that includes an initiator, a monomer, a cross-linker, and a surfactant in a common solvent to form a solution;

applying the solution to the charge generation layer; and cross-linking the solution to form a semi-interpenetrating polymer network comprising the polymeric or oligomeric charge transport material embedded in a cross-linked polymer matrix, wherein the polymeric or oligomeric charge transport material has a chemical structure shown in Formula I:

Formula I

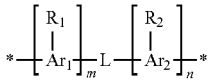

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, $C(O)OR_4$, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from the group consisting of hydrogen, C1-C30 alkyl and C1-C30 aryl, and the like;

L is a linker that connects two aromatic rings selected from the group consisting of nitrogen and a single bond; and m and n are integers independently having a value between 0 and about 5,000, with the proviso that at least one of m or n is not 0.

5. The process of claim 4 wherein molecules of the charge transport material are substantially uniformly distributed within the matrix and are capable of transporting hole carriers.

6. The process of claim 4 wherein the following components are mixed in the concentrations given to form the solution:

about 0.1 to 40 wt % hole transport polymer or oligomer;

about 0.1 to 50 wt % cross-linkable monomer;

about 0.1 to 50 wt % cross-linking agent;

about 0.1 to 20 wt % initiator; and about 20 wt % or more solvent.

7. The process of claim 4 wherein the mixture is applied to the charge generation layer by any of roll-coating, dip coating, spray coating, roll-to-roll coating, or printing methods.

8. The process of claim 4 wherein the mixture on the charge generation layer is cross-linked by exposure to heat for a period of time.

9. The process of claim 4 wherein the mixture on the charge generation layer is cross-linked by exposure to ultraviolet (UV) radiation for a period of time.

10. The method of claim 4 wherein the cross-linked polymer matrix is based on monomers selected from the group consisting of N-alkyl acrylamides, N-aryl acrylamides and N-alkoxyalkyl acrylamides, the corresponding methacrylamides, N-vinyl amides, N-vinyl cyclic amides, heterocyclic vinyl amines, polyethylene glycolated acrylates and methacrylates, polyethylene glycolated methacrylates, cationic monomers, and combinations thereof.

11. The method of claim 4 wherein the cross-linking agent is selected from the group consisting of 2-branch, 3-branch, and 4-branch cross-linkers that can be initiated with energy provided by heat or UV.

12. The method of claim 11 wherein the cross-linking agent is selected from the group consisting of (a) a thermal-initiated or UV-initiated cross-linker and (b) an initiator system having (i) a photo-initiator component or a thermal-initiator component; and (ii) an accelerator component comprising a nitrogen-containing monomer.

13. The method of claim 4 wherein the initiator is selected from the group consisting of thermally-activated initiators and photo-activated initiators.

14. The method of claim 4 wherein the solvent is selected from the group consisting of CHCl3, toluene, xylenes, methanol, ethanol, isopropanol, hexafluoro-iso-propanol, THF, benzene, DMF, and mixtures thereof.

15. The method of claim 4 further comprising adding about 1 to 20 wt % of a functionalized inorganic oxide, nitride, or carbide, or mixture thereof, to the solution, the functionalized inorganic oxide, nitride, carbide, or mixture thereof having a particle size of less than 100 nm.

* * * * *